US006017029A

United States Patent [19]

Bates et al.

[11] Patent Number: 6,017,029

[45] Date of Patent: Jan. 25, 2000

[54] HOPPER LOADER FOR FEEDING VERTICAL SIGNATURES TO BINDERY EQUIPMENT

[75] Inventors: Jerry L. Bates, Redlands; Everardo Garza, Highland, both of Calif.

[73] Assignee: Baldwin Technology Corporation, Rosemont, Ill.

[21] Appl. No.: 08/954,867

[22] Filed: Oct. 21, 1997

[51] Int. Cl.[7] ..... B65H 5/22

[52] U.S. Cl. ..... 271/3.12; 271/3.13; 271/3.17; 271/31.1; 271/150

[58] Field of Search ..... 271/3.01, 3.12, 271/3.13, 3.17, 31.1, 97, 149, 150, 161, 167, 169

[56] References Cited

U.S. PATENT DOCUMENTS

| | | | |
|---|---|---|---|
| 3,037,665 | 6/1962 | Bradmiller et al. | 221/251 |
| 3,741,413 | 6/1973 | Friel | 214/41 |
| 4,180,259 | 12/1979 | Bewersdorf et al. | 271/200 |
| 4,373,710 | 2/1983 | Hansen et al. | 271/55 |
| 4,436,297 | 3/1984 | Chandhoke | 271/3.1 |
| 4,869,486 | 9/1989 | Scarpa et al. | 271/3.12 |
| 4,973,038 | 11/1990 | Curley et al. | 271/146 |
| 5,088,711 | 2/1992 | Newsome | 270/54 |
| 5,114,129 | 5/1992 | Chang et al. | 270/1.1 |
| 5,238,239 | 8/1993 | Lachapelle | 271/275 |
| 5,282,613 | 2/1994 | Standerfer et al. | 271/202 |
| 5,290,025 | 3/1994 | Plent et al. | 271/181 |
| 5,354,045 | 10/1994 | Boldrini et al. | 271/11 |
| 5,374,050 | 12/1994 | Prim | 271/221 |
| 5,527,025 | 6/1996 | Schlough | 270/58.06 |

FOREIGN PATENT DOCUMENTS

| | | | |
|---|---|---|---|
| 2404627 | 9/1974 | Germany . | |
| 2135978 | 9/1984 | United Kingdom | B65H 5/02 |

*Primary Examiner*—David H. Bollinger
*Attorney, Agent, or Firm*—Roberts & Mercanti, L.L.P.

[57] ABSTRACT

A hopper loader apparatus for transferring and separating individual signatures of sheet material from a vertically aligned, parallelepiped shaped stack of such signatures. The separated, individual signatures may then be subjected to handling operations such as stapling or stitching. The hopper-loader has a first, downwardly inclined, planar conveyor, a second upwardly inclined, planar ramp conveyor which separates individual signatures from the stack and moves the signatures at a faster speed than the first conveyor. An included angle is formed between the first and second conveyors which ranges from about 125° to about 145° . Signatures are delivered to a pocket having spaced side walls and having a floor comprising a third intermittent indexing conveyor which sequentially moves the individual signatures away from the second conveyor and makes them available to stapling or stitching equipment.

24 Claims, 3 Drawing Sheets

HOPPER LOADER FOR FEEDING VERTICAL SIGNATURES TO BINDERY EQUIPMENT

BACKGROUND OF THE INVENTION

1. Field of the Invention

The present invention relates to signature handling equipment which supplies signatures in an on-edge orientation one at a time to bindery equipment. The invention particularly pertains to a hopper loader apparatus for transferring and separating individual signatures of sheet materials from a vertically aligned, parallelepiped shaped stack of such signatures. The separated, individual signatures may then be subjected to bindery operations such as stapling or stitching.

2. Description of the Prior Art

It is usual in the graphic arts that sheet materials such as newspapers, books, printed cartons and the like emerge from a printing operation in a serial stream of partially overlapping signatures in shingled form. Such a stream of signatures is collected on a conveyor and moved to a stacker for aligning. The stacker receives the sheets in a serial mode from the conveyor and forms an aligned stack for removal and transportation. While large numbers of signatures can be conveniently handled in stack form, some operations on the signatures can only be performed individually. These include such bindery operations as stitching and stapling, among others. It therefore becomes necessary to separate individual signatures from a stack for individual treatment. A signature feed assembly is commonly used to feed signatures one at a time from a hopper onto a conveyor. One known assembly for feeding signatures one at a time onto a conveyor is disclosed in U.S. Pat. No. 4,180,255. Known signature supply assemblies have previously been used to supply signatures to a hopper in a signature feed assembly. Known signature supply assemblies or hopper loaders are disclosed in U.S. Pat. Nos. 3,674,258 and 3,945,633. The signature supply assemblies disclosed in the aforementioned patents supply signatures to a hopper in a generally horizontal orientation. Although hopper loaders are known in the art to supply a stream of generally horizontally positioned signatures, upstanding on-edge vertical signatures are generally required for feeding the signatures one at a time for processing by a stitcher line.

Signature supply assemblies for supplying signatures in a vertical, an on-edge orientation are disclosed in U.S. Pat. Nos. 4,177,982 and 4,436,297. The complicated nature of the construction and mode of operation of known on-edge signature supply assemblies increases the probability of a jam or other malfunction during operation of the signature supply assemblies. In addition, the more complicated the construction of the signature supply assembly, the greater will be the cost of construction. The present invention seeks to simplify hopper loader construction cost.

It has been a problem in the art to reliably provide an efficient and effective means of separating a stack into its individual signatures for presentation to such bindery equipment. Prior art hopper loaders do not run reliably with a large range of signature sizes. The paper stock may range from heavyweight to lightweight and from a few pages per signature to many pages per signature. This difference in paper weight and/or pagination has required the operator to perform many adjustments to make the machine ready for a production run.

In addition, prior art hopper loaders for bindery equipment must be relatively fixed in position. That is, due to its complexity and the need to critically place the hopper loader in correct position adjacent to the bindery equipment, the hopper loader has not been mobile. That is, one cannot easily move the prior hopper loaders from one piece of bindery equipment to another. The present invention seeks to enhance hopper loader mobility. In the past, a stacked pile of printed signatures has been moved on a horizontal conveyor to an upwardly moving conveyor where both conveyors travel at the same speed. Such an operation has many disadvantages since the stack does not reliably separate into evenly speed overlapping individual signatures. This unevenness inevitably leads to down stream signature jams and misfeeds requiring considerable operator attention. U.S. Patent No. 4,180,259 discloses a system for varying the drop of sheets into a hopper. Signatures are fed in a shingled stream and dropped one-by-one into a hopper, which then feeds a gathering chain. Signatures are stripped from a stack and are passed around a complex series of rollers and a large drum ultimately to a pocket. U.S. Pat. No. 4,436,297 discloses a vertical hopper loader which feed signatures into a vertical pocket. A vertical stack of signatures is transported horizontally and then fed from a horizontal pocket to a vertical pocket formed on a conveyor belt. A second ramp conveyor does not form the signature into a rectangular array in a pocket. U.S. Pat. No. 5,374,050 discloses a conveyor wherein a stream of signatures is moved upwardly to a pocket having a jogger for the stacked stream of signatures. Difficulties in operating vertical loaders such as disclosed in these prior patents arise in that a large quantity of signatures cannot be loaded in the loader without interfering with the feeding of signature at the supply station, and the loaders cannot handle very short and very long signatures without substantial changes in the feeding mechanism. Further, the signatures are subjected to a constant riffling, sliding and jostling action that results in damage to the folds on the signatures when they move between conveyor belts. U.S. Pat. No. 4,973,038 also discloses a signature handling apparatus, however, this disclosure uses a horizontal feed conveyor which requires a stack pusher. The signatures tend to slide down a second ramp conveyor and hence require a retainer wedge. The present invention operates in the absence of such a pusher.

The present invention provides a vertical loader which avoids or reduces problems encountered in the prior art. The present invention pertains to an apparatus for separating individual signatures which are substantially vertically aligned on a folded edge from a stack of signatures and then feeding them into a pocket from which they are fed by a feed mechanism to bindery equipment. According to the present invention there is provided a vertical loader for bindery equipment including a conveyor to distribute a stack of signatures individually to bindery equipment. The loader includes a downwardly inclined conveyor that moves a stack of signatures to an upwardly inclined conveyor which strips individual signatures from the stack and forms them into an overlapping shingled stream. The stream of signatures then moves to a product pocket including side walls, an indexing chain floor, and a stripper bar on the lower portion of each side wall. A product holdback deters selection of more than one signature at a time that is sent to the stitcher line. A vibrating jogger over the pocket used to even out the top of the product in the pocket one. Individual signatures flow reliably, one-by-one downwardly out of the pocket to bindery equipment. The simplified equipment is economical, mobile, and signature size changeovers are easy to accomplish.

These and other features, advantages and improvements will be in part discussed and in part apparent to one skilled in the art upon a consideration of the detailed description of the preferred embodiment and the accompanying drawings.

SUMMARY OF THE INVENTION

The invention provides a hopper-loader which comprises:

a) a first, downwardly inclined, planar conveyor which is capable of moving a parallelepiped shaped stack of substantially vertically aligned on edge signatures at a first speed to a second conveyor;

b) a second, upwardly inclined, planar conveyor which is capable of separating individual signatures from the stack on the first conveyor at an entry end of the second conveyor and moving the signatures in an overlapping shingled stream up the second conveyor at a second speed faster than the first speed, and forming the signatures into a parallelepiped shaped array of substantially vertically aligned on edge signatures in a signature pocket at an exit end of the second conveyor; wherein an angle is formed between the first, downwardly inclined, planar conveyor and the second, upwardly inclined, planar conveyor which is from about 125° to about 145°;

c) the signature pocket having spaced side walls positioned on each of two lateral sides of the parallelepiped array; and having a floor comprising a third intermittent indexing chain conveyor capable of sequentially moving the individual signatures in the parallelepiped shaped array of signatures away from the second conveyor.

The invention also provides a process for discharging individual signatures from a parallelepiped shaped stack of substantially vertically aligned on edge signatures which comprises:

a) moving a parallelepiped shaped stack of substantially vertically aligned on edge signatures along a first downwardly inclined planar conveyor at a first speed;

b) separating individual signatures from the stack on the first conveyor and depositing the signatures in an overlapping shingled stream onto a second upwardly inclined planar conveyor moving at a second speed which is faster than the first speed, wherein an angle is formed between the first, downwardly inclined, planar conveyor and the second, upwardly inclined, planar conveyor which is from about 125° to about 145° , and moving the shingled stream of signatures with the second conveyor and forming them into a parallelepiped shaped array of substantially vertically aligned on edge signatures in a signature pocket; the signature pocket having spaced side walls positioned on each of two lateral sides of the parallelepiped shaped array and having a floor comprising a third indexing chain conveyor; and c) moving the individual signatures from the parallelepiped shaped array away in the second conveyor with the third conveyor.

DETAILED DESCRIPTION OF THE PREFERRED EMBODIMENT

Figure 1:
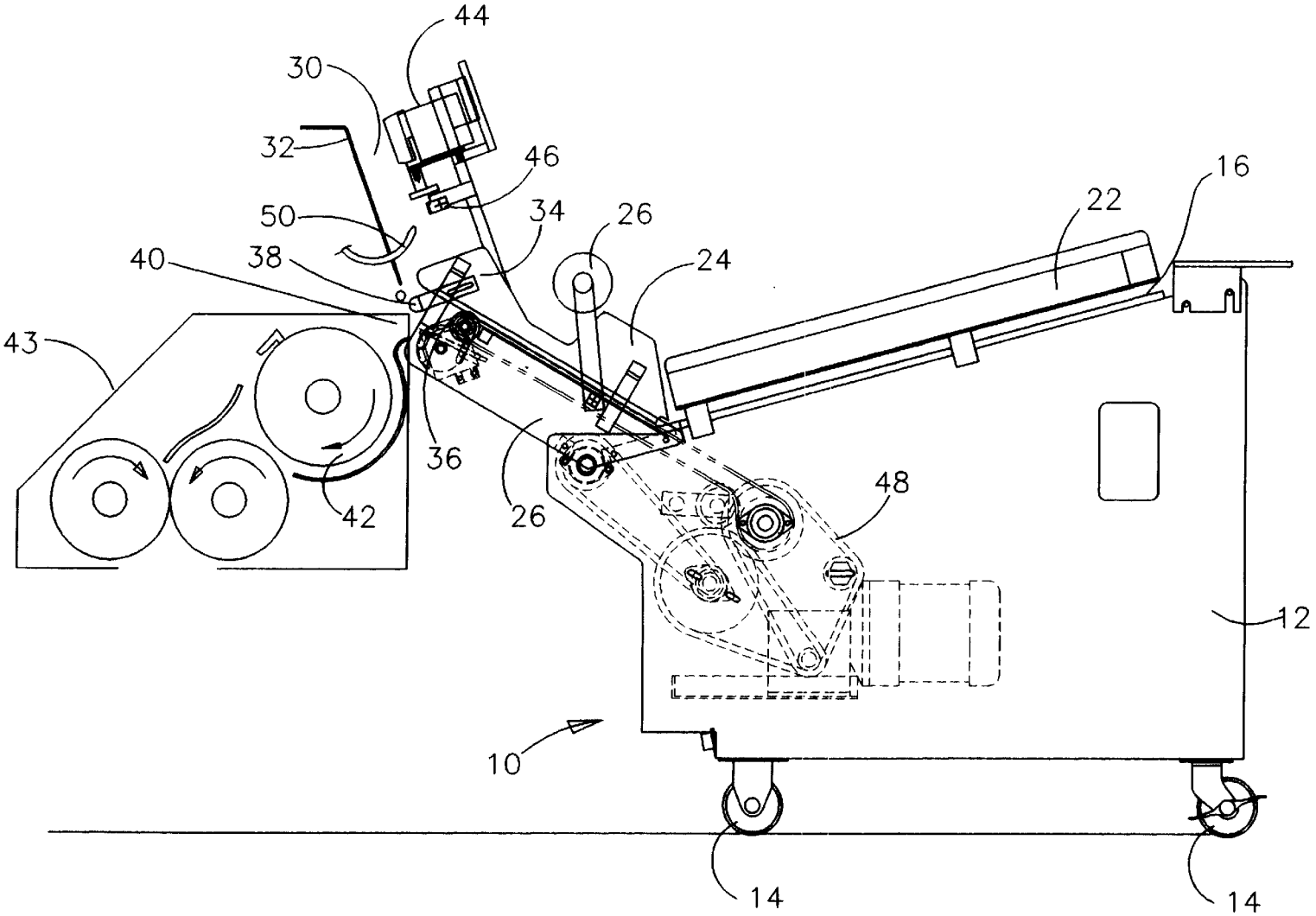
FIG. 1 shows a side view of a hopper loader according to the invention.
Figure 2:
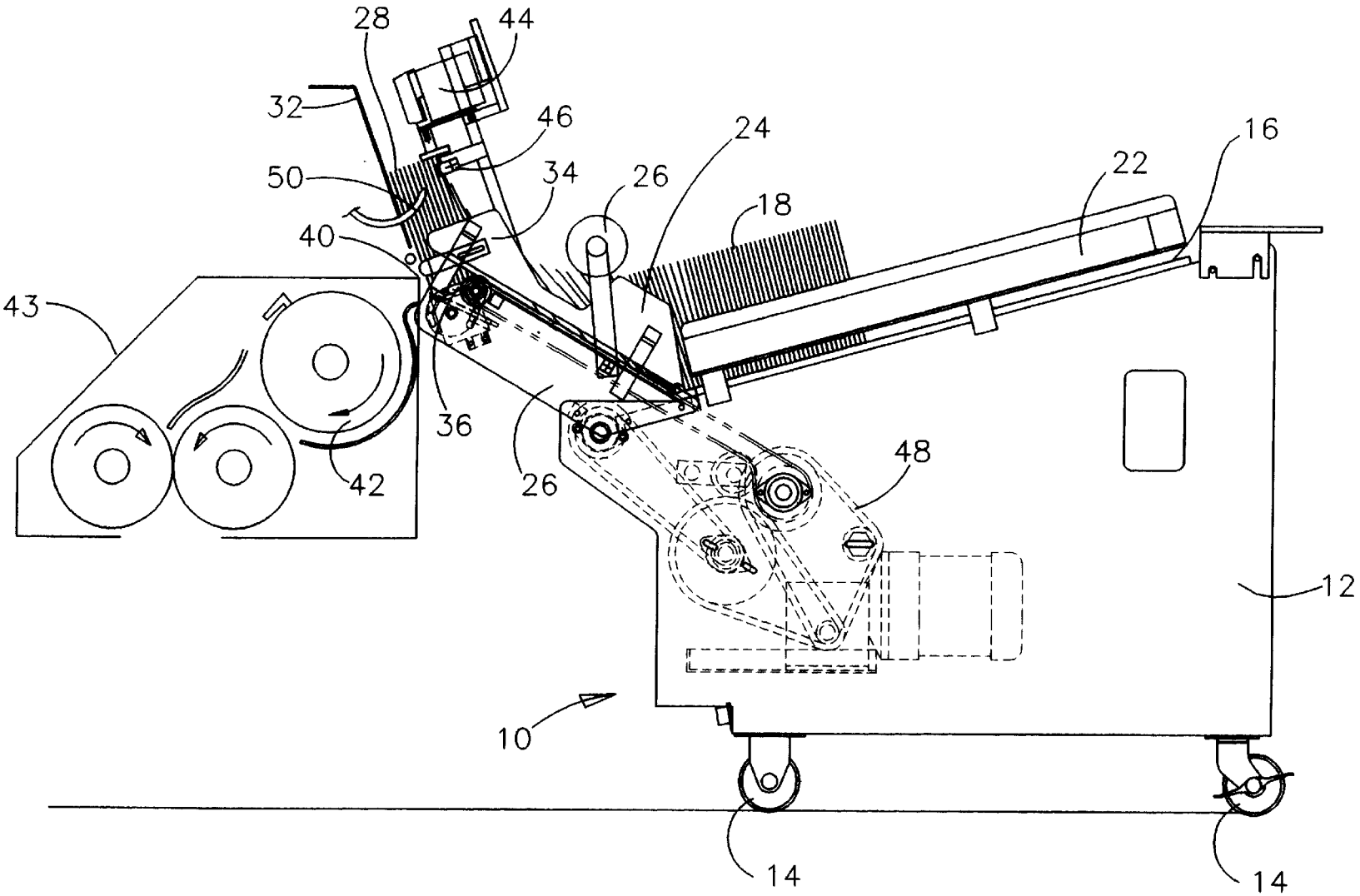
FIG. 2 shows a side view of a hopper loader according to the invention and further showing the movement path of signatures.

Referring to the drawings, FIGS. 1 and 2 show a hopper loader 10 according to the invention. It comprises a framework 12 which is movable by wheels 14. It has a first, downwardly inclined, planar conveyor 16 which preferably comprises a plurality of conveyor belts. In the preferred embodiment the belts are sturdy enough to move a relatively heavy stack of sheet signatures 18. As shown, the signatures are substantially vertically aligned and are in the form of a parallelepiped shaped stack. It is an important feature of the invention that the conveyor 16 be downwardly inclined. In the preferred embodiment, conveyor 16 has a downward decline measured from the horizontal of from about 10° to about 20°. This downward decline provides a gravity assist in the feeding of individual signatures from conveyor 16 to second upwardly inclined, planar conveyor section 20. In the preferred embodiment, the belts of the first conveyor are flat top chain belts and the second conveyor comprises a plurality of driven belts such that the belts of the first conveyor are interdigitated with the belts of the second conveyor.

The second conveyor 20 is capable of separating individual signatures from the stack on the first conveyor at an entry end of the second conveyor. Signatures fall over into an evenly overlapping shingled stream and travel up the second ramp conveyor as shown. In the preferred embodiment, the second conveyor has an upward incline measured from the horizontal of from about 25° to about 35°. An important feature of the invention is that an angle is formed between the first, downwardly inclined, planar conveyor and the second, upwardly inclined, planar conveyor which is from about 125° to about 145°. In addition, it is also important that the belts of the second conveyor belts travel at a speed which is faster than the belt speed of the first conveyor. In the preferred embodiment, the belt speed of the first conveyor ranges from about 0.75 feet/minute to about 2 feet per minute. In the preferred embodiment, the belt speed of the second conveyor ranges from about 2.75 feet/minute to about 5.75 feet per minute. Most preferably the speed ratio of the second conveyor to the first conveyor is from about 2:1 to about 4:1. Although the first and second conveyors seem to operate relatively continuously, they preferably intermittently feed signatures to the pocket responsive to a signal from a sensor as described hereinafter. This combination of downward sloping first conveyor, upward sloping second conveyor, included angle of from about 125° to about 145° and speed differential gives a smooth, even transition from a stack of signatures to a thick shingled stream of even overlapping individual signatures. The hopper loader configuration according to the invention, allows processing of a wide variety of sizes of signatures from thick multipage books to thin signatures having a very few pages.

In the preferred embodiment, the signatures are supported down the first conveyor by a side guide 22 and the signatures are supported up the second conveyor by a side guide 24. In one embodiment of the invention, a stripper roller 26 is positioned above the second conveyor 20 to assist removing individual signatures from stack 18.

Figure 3:
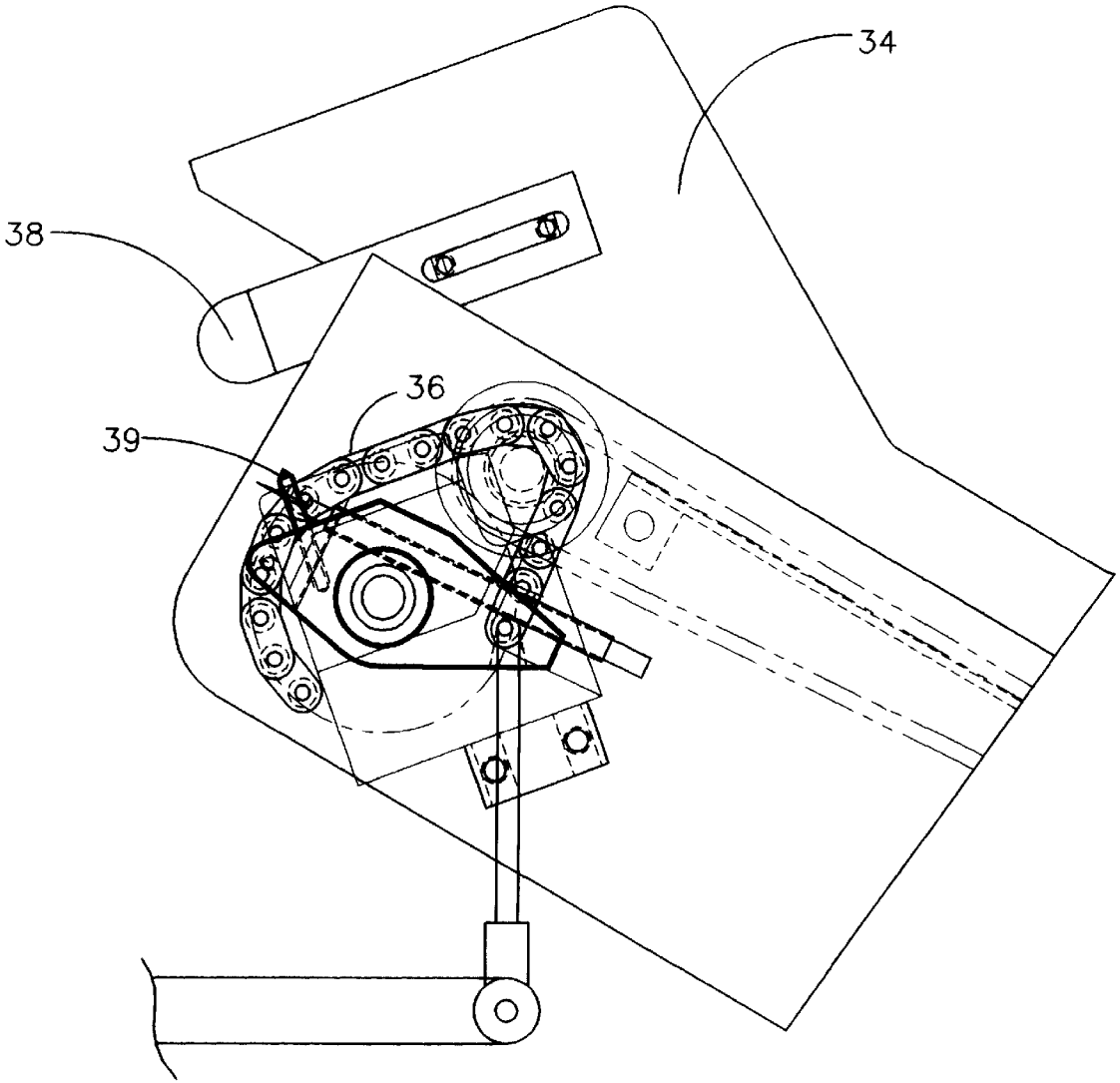
FIG. 3 shows a feed pawl arrangement useful for the invention.

The shingled stream of individual signatures travels up the incline of second conveyor and they are formed into a parallelepiped shaped array of substantially vertically aligned on edge signatures 28 in a signature pocket 30 at an exit end of the second conveyor. The array is preferably from about 2 inches to about 4 inches thick. The formation of the array in the pocket having a relatively few vertical signatures results from the need to minimize the forward pressure on the forwardmost signature to be released from preceding signatures. The pocket is formed by spaced side walls 34 positioned on each of two lateral sides of the rectangular array. In one embodiment of the invention, the pocket comprises a front wall 32 in front of the side walls 34. In another embodiment of the invention, the front wall is part of subsequent bindery equipment. The pocket has a floor comprising a third conveyor 36 which is an intermittent indexing conveyor capable of sequentially moving the individual signatures away from the second conveyor. In the preferred embodiment, third conveyor is a generally eccentric loop which travels around a chain drive sprocket and a roller. The roller should be as small as possible to provide a small nip point transition between the second and third conveyors to provide a short release point for each signature. The loop has a short travel path and generally has a length in the pocket on the order of from about 2 to about 5 inches. The movement of the indexing chain conveyor is preferably controlled by a one way clutch or feed pawl 39 which is well known in the art and which is shown in FIG. 3. Extending forward from at least one and preferably each of the side walls 34 are optional but preferred, adjustable signature holdback means such as holdback bars 38. These holdback bars are required for some products but are optional for others. The space between the holdback bars is preferably less than the space between the side walls. These holdback bars serve to bow back the side edges of the signatures as they are moved forward by the indexing chain conveyor. The holdback bars keep the signatures behind the first signature in a bowed shape such that the signatures immediately following the first signature becomes stiffened by the bow thereby preventing rollout or other disruption of the second and following signatures as the first signature is pulled from the stack. This action assists in reliably separating each individual signature in the pocket for downward removal at exit point 40 by signature removal means 42 such as a rotary gripper, stripper pins or swing arm vacuum cups which attach to the spine of a signature and pull it away from the signature array. These removal means select one signature at a time and pull that signature down through the exit point to signature binding apparatus 43. Separation of the individual signatures can also be assisted by an air blower 50 which blows air into the signature array. In the preferred embodiment, the top edges of the array of signatures 28 are leveled by a high frequency vibrating jogger 44. By leveling the tops of the signatures in the array, the signature bottoms are also evened with respect to the signature removal means 42. The well jogged bottoms of the signatures in the array result in more reliable, continuous feeding of individual signatures regardless of paper weight, caliper and other variables. The presence of the top jogger dramatically reduces the number of misfeeds.

Preferably, the hopper loader has a signature sensor 46 such as a photoeye, at the signature pocket, which controls the moving of the first conveyor and the second conveyor responsive to the presence or absence of a signature at the last position in the pocket and keeps the pocket filled with signatures. The photoeye is preferably set to examine the side of the last expected signature in the pocket. Thus when the last signature has been moved forward by the indexing chain conveyor, the photoeye senses the absence of a signature at that position and issues a signal to drives for the first and second conveyors to move the next signature forward. Thus signature advance is ultimately controlled by the independent action of the indexing chain conveyor in positioning and removing signatures. The first and second conveyors intermittently stop and start and hence replenish signatures into the pocket as required. The movement of the first and second conveyors is accomplished by suitable drive means including motors, pulleys, belts and rollers shown generally at 48. Preferably the movement of the third conveyor is accomplished by suitable drive means including the feed pawl, a ratchet assembly, motors, pulleys, belts and rollers which are independent of the drive means 48 for the first and second conveyors. It is understood that the provision of such suitable drive means is well within the ability of those skilled in the art.

What is claimed is:

1. A hopper-loader which comprises:

a) a first, downwardly inclined, planar conveyor which is capable of moving a parallelepiped shaped stack of substantially vertically aligned on edge signatures at a first speed to a second conveyor;

b) a second, upwardly inclined, planar conveyor which is capable of separating individual signatures from the stack on the first conveyor at an entry end of the second conveyor and moving the signatures in an overlapping shingled stream up the second conveyor at a second speed faster than the first speed, and forming the signatures into a parallelepiped shaped array of substantially vertically aligned on edge signatures in a signature pocket at an exit end of the second conveyor; wherein an angle is formed between the first, downwardly inclined, planar conveyor and the second, upwardly inclined, planar conveyor which is from about 125° to about 145°;

c) the signature pocket having spaced side walls positioned on each of two lateral sides of the parallelepiped array; and having a floor comprising a third intermittent indexing chain conveyor capable of sequentially moving the individual signatures in the parallelepiped shaped array of signatures away from the second conveyor.

2. The hopper loader of claim 1 wherein the signature pocket further comprises a front wall.

3. The hopper loader of claim 1 further comprising signature holdback means on at least one of the side walls and extending forward wherein the distance between the holdback means and the opposite side wall is less than the space between the side walls.

4. The hopper loader of claim 1 further comprising a signature holdback bar on each of the side walls and extending forward wherein the distance between the holdback bars is less than the space between the side walls.

5. The hopper loader of claim 1 further comprising a roller which acts to separate the individual signatures from the stack on the first conveyor onto the second upwardly inclined planar conveyor.

6. The hopper loader of claim 1 wherein the third conveyor has a length in the pocket of from about 2 to about 5 inches.

7. The hopper loader of claim 1 wherein the moving of the indexing chain conveyor is controlled by a feed pawl.

8. The hopper loader of claim 1 wherein the first conveyor has a downward decline measured from the horizontal of from about 10° to about 20°.

9. The hopper loader of claim 1 wherein the second conveyor has an upward incline measured from the horizontal of from about 25° to about 35°.

10. The hopper loader of claim 1 further comprising a vibrating jogger positioned over the pocket which uniformly levels the tops of the signatures in the pocket.

11. The hopper loader of claim 1 further comprising an air blower which blows air into the parallelepiped array.

12. The hopper loader of claim 1 further comprising means for removing individual signatures downwardly out of the pocket.

13. The hopper loader of claim 1 further comprising a signature sensor at the signature pocket, which sensor controls the moving of the first conveyor and the second conveyor responsive to the presence or absence of a signature at a position in the pocket.

14. The hopper loader of claim 13 wherein the sensor comprises a photoelectric cell.

15. The hopper loader of claim 1 wherein the first conveyor comprises a plurality of driven flat top chain belts and the second conveyor comprises a plurality of driven belts such that the belts of the first conveyor are interdigitated with the belts of the second conveyor.

16. The hopper loader of claim 1 further comprising a signature holdback bar on each of the side walls and extending forward wherein the distance between the holdback bars is less than the space between the side walls; wherein the third conveyor has a length in the pocket of from about 2 to about 5 inches and the moving of the indexing chain conveyor is controlled by an feed pawl; wherein the first conveyor has a downward decline as measured from the horizontal of from about 10° to about 20° and the second conveyor has an upward incline as measured from the horizontal of from about 25° to about 35°, comprising a vibrating jogger positioned over the pocket which uniformly levels the tops of the signatures in the pocket; wherein the first conveyor comprises a plurality of driven flat top chain belts and the second conveyor comprises a plurality of driven belts such that the belts of the first conveyor are interdigitated with the belts of the second conveyor; and comprising a photoelectric cell at the signature pocket wherein the photoelectric cell controls the moving of the first conveyor and the second conveyor responsive to the presence or absence of a signature at a position in the pocket.

17. The hopper loader of claim 16 further comprising means for removing individual signatures downwardly out of the pocket.

18. The hopper loader of claim 1 wherein the ratio of the first speed to the second speed is from about 2:1 to about 4:1 .

19. A process for discharging individual signatures from a parallelepiped shaped stack of substantially vertically aligned on edge signatures which comprises:

a) moving a parallelepiped shaped stack of substantially vertically aligned on edge signatures along a first downwardly inclined planar conveyor at a first speed;

b) separating individual signatures from the stack on the first conveyor and depositing the signatures in an overlapping shingled stream onto a second upwardly inclined planar conveyor moving at a second speed which is faster than the first speed, wherein an angle is formed between the first, downwardly inclined, planar conveyor and the second, upwardly inclined, planar conveyor which is from about 125° to about 145°, and moving the shingled stream of signatures with the second conveyor and forming them into a parallelepiped shaped array of substantially vertically aligned on edge signatures in a signature pocket; the signature pocket having spaced side walls positioned on each of two lateral sides of the parallelepiped shaped array and having a floor comprising a third indexing chain conveyor; and c) moving the individual signatures in the parallelepiped shaped array away from the second conveyor with the third conveyor.

20. The process of claim 19 further comprising separating each individual signature with a holdback bar on each of the side walls and extending forward wherein the distance between the holdback bars is less than the space between the side walls.

21. The process of claim 19 further comprising jogging the signatures in the pocket with a vibrating jogger positioned over the pocket which uniformly levels the tops of the signatures in the pocket.

22. The process of claim 19 further comprising removing individual signatures downwardly out of the pocket.

23. The process of claim 19 wherein the signature pocket further comprises a front wall.

24. The process of claim 19 wherein the ratio of the first speed to the second speed is from about 2:1 to about 4:1.

* * * * *